US005392920A

United States Patent [19]

Prete

[11] Patent Number: 5,392,920

[45] Date of Patent: Feb. 28, 1995

[54] IMPACT PROTECTOR FOR FRAGILE ARTICLE

[76] Inventor: Richard Prete, 3 University Pl., Lake Success, N.Y. 11020

[21] Appl. No.: 194,718

[22] Filed: Feb. 10, 1994

[51] Int. Cl.[6] ..... B65D 81/08

[52] U.S. Cl. ..... 206/586; 206/320

[58] Field of Search ..... 206/586, 320, 305

[56] References Cited

U.S. PATENT DOCUMENTS

| | | | |
|---|---|---|---|
| 2,885,139 | 5/1959 | Werner et al. . | |
| 3,047,142 | 7/1962 | Heffley . | |
| 3,049,260 | 8/1962 | Stone | 206/586 |
| 3,073,439 | 1/1963 | Symonds, Jr. . | |
| 3,335,932 | 8/1967 | Brown . | |
| 4,238,031 | 12/1980 | Skaggs . | |
| 4,925,149 | 5/1990 | DiFrancesca et al. . | |
| 5,040,684 | 8/1991 | Knowles . | |
| 5,060,801 | 10/1991 | Vilas-Boas . | |
| 5,299,685 | 4/1994 | Chin | 206/586 |

FOREIGN PATENT DOCUMENTS

| | | | |
|---|---|---|---|
| 170265 | 7/1993 | Japan | 206/586 |

OTHER PUBLICATIONS

Tuscarora Plastics Packaging vol. 29, No. 3, Mar. 1984 p. 28.

*Primary Examiner*—William I. Price
*Attorney, Agent, or Firm*—Hoffmann & Baron

[57] ABSTRACT

An impact protector for securement to an edge of a fragile article, for example, a pen-based computer. The protector includes a pair of opposing support legs having support surfaces located thereon which prevent the computer-contacting walls of the protector from directly striking the ground if the computer is accidently dropped or jarred.

14 Claims, 6 Drawing Sheets

IMPACT PROTECTOR FOR FRAGILE ARTICLE

BACKGROUND OF THE INVENTION

The present invention relates to an impact protector and, more particularly, to an impact protector for securement to an edge of a fragile article.

It is oftentimes desirable to protect a fragile article from accidental "dropping" or "jarring" during handling of such article. It is most important to protect the edges and, particularly, the corners, from sustaining direct blows. Specifically, if an impact blow is delivered directly to the edge or corner of an article, the impact energy will be concentrated over a relatively small surface area, typically resulting in damage to the article.

One such article particularly susceptible to impact damage is the portable computer. As is well-known, there is an ever increasing use of portable computers (e.g., pen-based computers) in the field. For example, pen-based computers are commonly employed by delivery companies to electronically record deliveries. The delivery person typically carries the computer on his person from delivery to delivery. The computer is, for the most part, continuously in use and is therefore likely, at some point, to be accidentally dropped or jarred.

Various carrying cases, which generally enclose the entire computer, already exist. However, these cases are somewhat impractical in the field. Particularly, because the computer is, for the most part, continuously in use, such cases can become a nuisance to the user. The user is therefore likely to simply discard the conventional case, leaving the computer permanently unprotected.

The prior art has considered impact protectors for other applications. For example, U.S. Pat. No. 3,047,142 discloses a hollow-ribbed mirror corner protector. The disclosed protector includes hollow ribs that project outwardly from the edge of the corner protector. These ribs, although sufficient to protect the edge of a mirror during static conditions, would be insufficient to protect a pen-based computer from an impact if, for example, such computer were dropped onto a hard surface.

Similarly, U.S. Pat. No. 4,238,031, which discloses an edge protector for the edge of a fragile article (e.g., a sheet of glass) and U.S. Pat. No. 4,925,149, which discloses a shock absorbing unit (e.g., for a remote controlled device), would also be unable to sufficiently protect the edge or corner of a fragile article, such as a pen based computer, if such computer were dropped onto a hard surface.

It would therefore be desirable to provide an impact protector for securement to the edge of a fragile article, such as a pen based computer, that would protect the edges and corners of the article from impact forces if such article is accidently dropped or jarred during its use.

SUMMARY OF THE INVENTION

The present invention, which addresses the needs of the prior art, provides an impact protector for securement to an edge of a fragile article. The protector is a generally resilient member having a pair of opposing side walls and a bottom wall extending therebetween. The walls define an article-receiving groove sized to accommodate the edge of the article. The member further includes a pair of opposing support legs attached thereto and having support surfaces located thereon which prevent the walls from directly striking a ground plane when the member is dropped.

In a preferred embodiment, each of the walls has an inner article-contacting surface and an outer free surface. The support legs are positioned at the intersections of the side and bottom walls. Each of the support legs includes first and second support surfaces. The first support surfaces are laterally offset from the outer free surface of the bottom wall and are formed substantially parallel thereto. The second support surfaces are laterally offset from the outer free surfaces of the side walls and are formed substantially parallel thereto.

The present invention also provides a method for protecting a fragile article from impact damage. The method includes the step of securing a generally resilient member having a pair of opposing side walls and a bottom wall extending therebetween to an edge of a fragile article. The walls define an article-receiving groove sized to accommodate the edge of the article. The member also includes a pair of opposing support legs attached thereto and having support surfaces located thereon which prevent the walls from directly striking a ground plane when the member is dropped thereon.

As a result, the present invention provides an impact protector for securement to an edge of an article. The impact protector ensures that the article-contacting walls cannot directly strike a ground plane (whereby the impact energy would be concentrated over a small surface area) if the article is dropped. Rather, the impact energy is dispersed throughout the protector, thereby reducing the likelihood of the article being damaged.

DETAILED DESCRIPTION OF THE INVENTION

Figure 1:
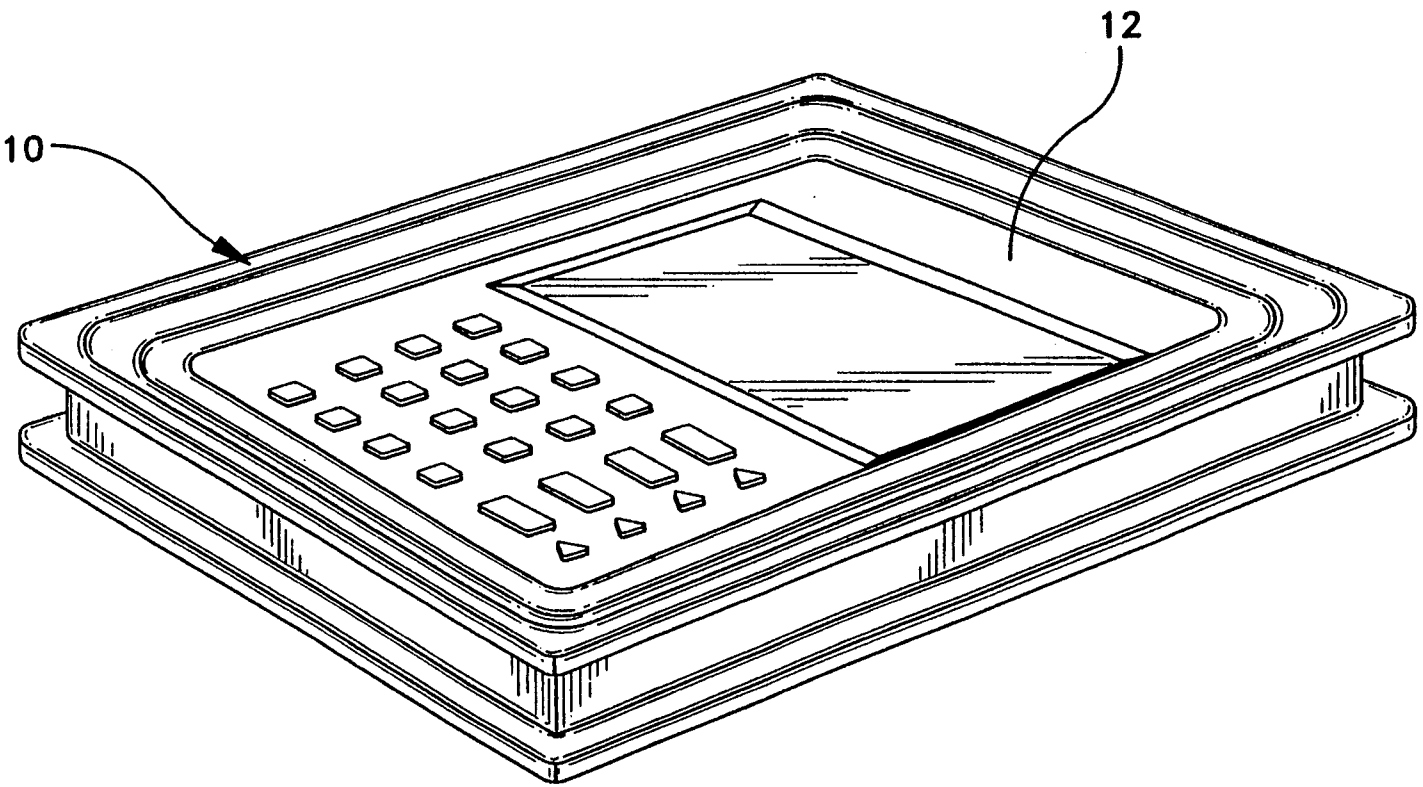
FIG. 1 is a perspective view of the impact protector of the present invention installed on a pen-based computer.

Referring to the drawings, an impact protector 10 is shown in FIG. 1. The impact protector is preferably a resilient member configured for securement to the outside edges of a fragile article, for example, a pen-based computer 12.

Figure 2:
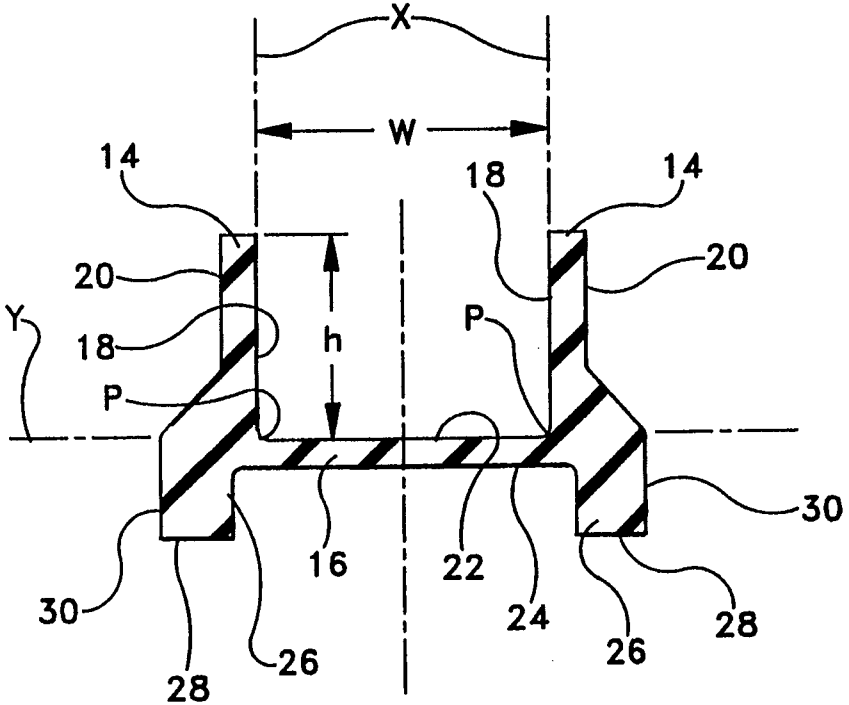
FIG. 2 is a cross-sectional view of the impact protector of FIG. 1 with the computer removed for clarity.

As shown in FIG. 2, the impact protector has a generally H-shaped cross-section. The protector includes a pair of opposing side walls 14, which are symmetrical about an axis S, and a bottom wall 16, which extends between the two side walls. Each of side walls 14 includes an inner article-contacting surface 18 (which define locating planes X) and an outer free surface 20. Similarly, bottom wall 16 includes an inner article-contacting surface 22 (which defines locating plane Y), and an outer free surface 24. Locating planes X and locating plane Y intersect along lines P.

As illustrated, side walls 14 and bottom wall 16 define an article-receiving groove sized to accommodate the edge of a fragile article. Preferably, the groove releasably engages the edge of the article through a friction fit. However, the protector may also be attached to the article by fasteners, adhesives, etc. The width w and height h of the groove can be readily modified to accommodate edges of various dimensions.

The impact protector further includes a pair of opposing support legs 26 positioned at the intersections of the side and bottom walls. Each of the support legs includes support surfaces 28, 30. These support surfaces prevent the outer free surfaces of the walls from directly striking a ground plane when the article is dropped.

Specifically, support surfaces 28 are formed substantially parallel to the outer free surface of the bottom wall and, further, are laterally offset therefrom. Support surfaces 30 are formed substantially parallel to the outer free surfaces of the side walls and, further, are laterally offset therefrom. The side walls are preferably formed substantially perpendicular to the bottom wall, and therefore support surfaces 28, 30 are formed substantially perpendicular to one another. However, other geometric configurations of the support surfaces and/or arrangements thereof that prevent the article-contacting walls of the protector from directly striking the ground if the article is dropped are also contemplated.

Figure 3:
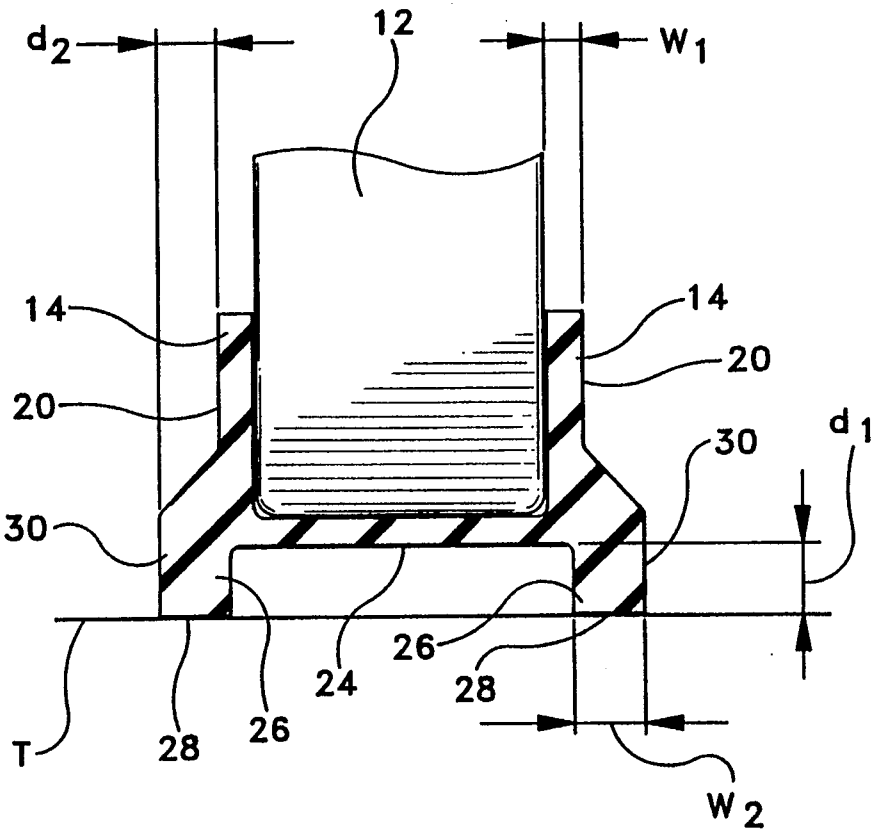
FIG. 3 is an enlarged cross-sectional view similar to FIG. 2 showing the protector engaged with the edge of the computer.

Referring to FIG. 3, each of side walls 14 is formed with a width $w_1$, while each of support legs 26 is formed with a width $w_2$. As shown, width $w_2$ is preferably greater than width $w_1$. Further, support surfaces 28 are laterally offset a distance $d_1$ from outer free surface 24, while support surfaces 30 are laterally offset a distance $d_2$ from outer free surfaces 20.

Figure 4:
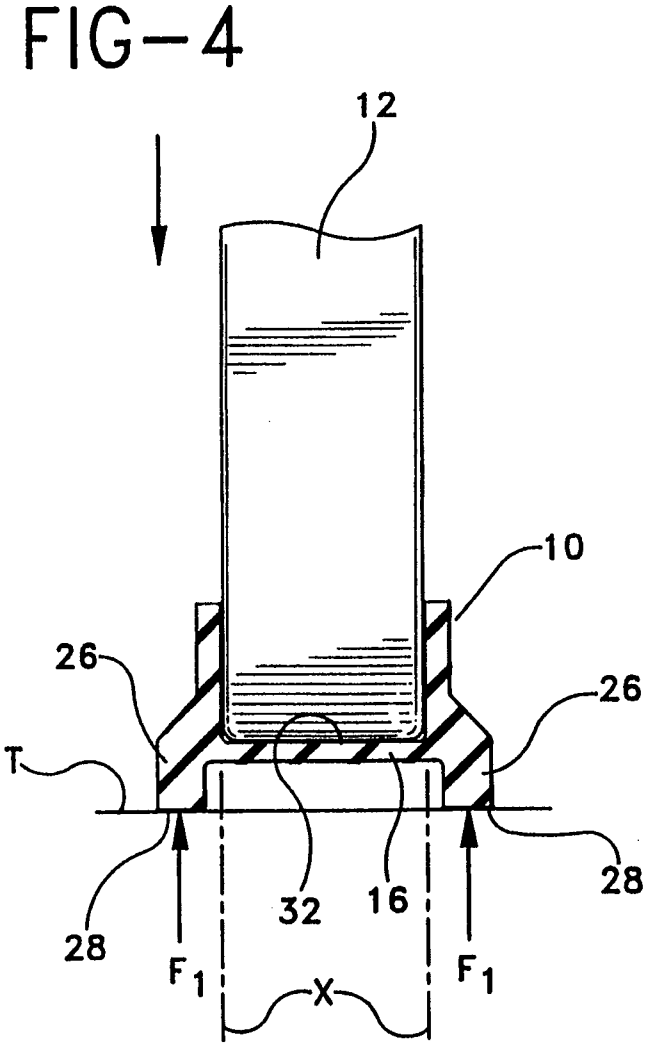
FIG. 4 is a cross-sectional view showing the protector/computer combination dropped with its side parallel to a ground surface.

If the protector/computer combination is dropped with its side 32 parallel to ground surface T (as shown in FIG. 4), the protector/computer combination will land on support surfaces 28. As shown, support surfaces 28 are preferably positioned on the outward sides of locating planes X. Accordingly, a direct path (i.e., a path perpendicular to ground surface T between such ground surface T and bottom wall 16) does not exist. The impact energy imparted on the protector (through forces $F_1$) is therefore dispersed throughout the protector (resulting in flexing of the protector) and is not delivered directly to bottom wall 16.

Figure 5:
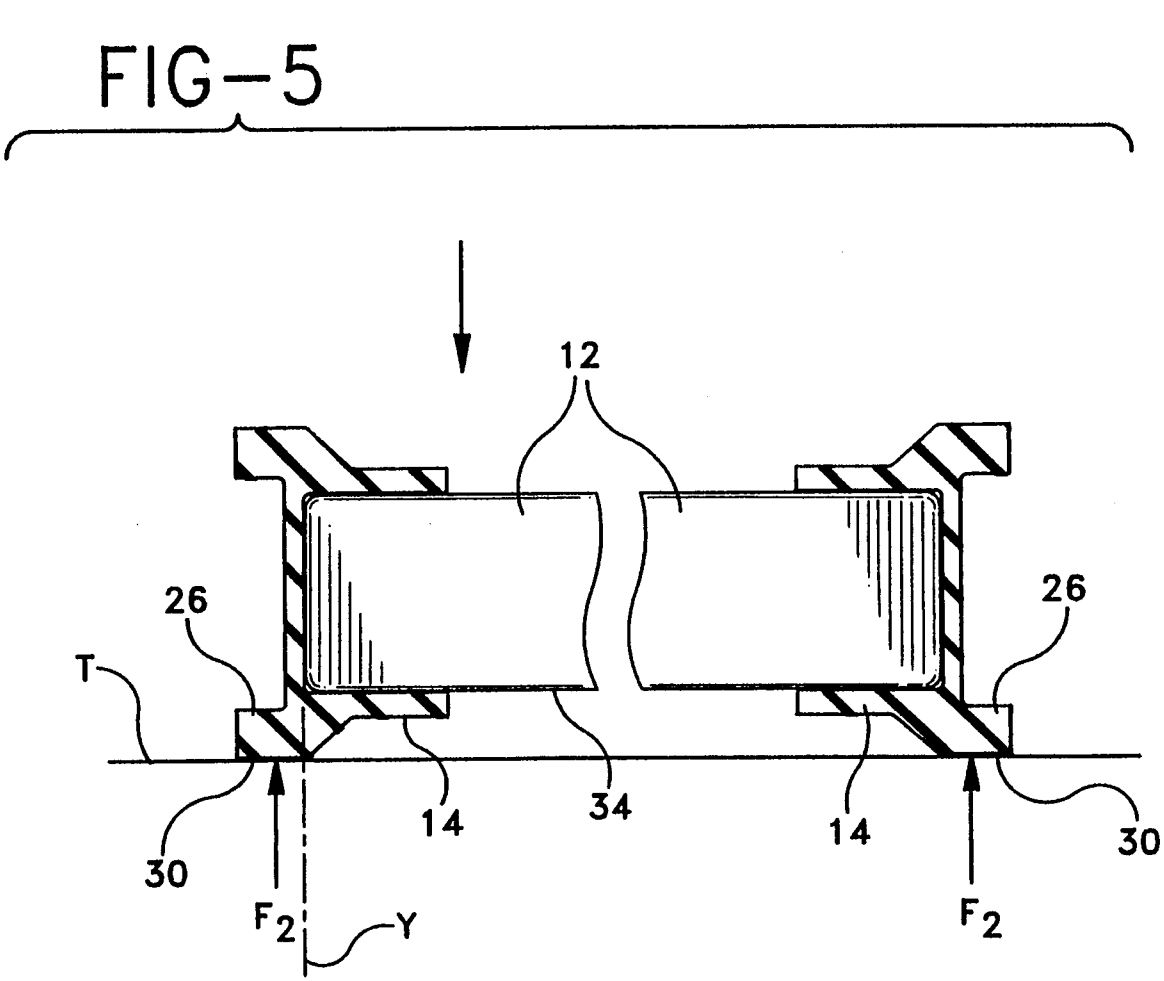
FIG. 5 is a cross-sectional view showing the protector/computer combination dropped with its face parallel to a ground surface.

Referring to FIG. 5, if the protector/computer combination is dropped with its face 34 parallel to ground surface T, the protector/computer combination will land on support surfaces 30. As shown, support surfaces 30 are preferably positioned on the outward side of locating plane Y. Again, a direct path (i.e., a path perpendicular to ground surface T between such ground surface T and side wall 14) does not exist. The impact energy imparted on the protector is therefore dispersed throughout the protector and is not delivered directly to the article-contacting wall, i.e., side wall 14.

Figure 6:
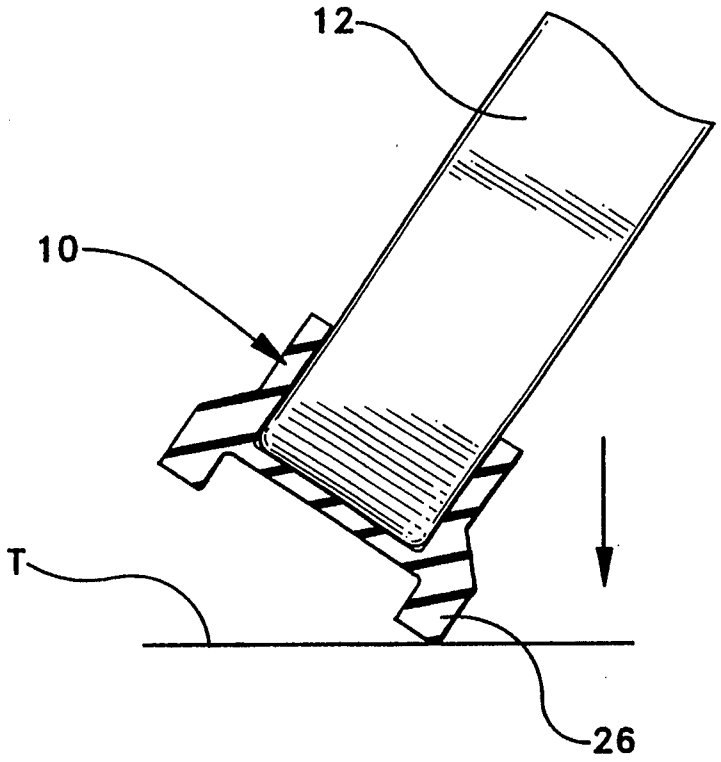
FIG. 6 is a cross-sectional view showing the protector/computer combination dropped on an angle with respect to a ground surface.

The edge protector of the present invention also protects the computer when the protector/computer combination is dropped on an angle with respect to ground surface T such that it lands on only one support leg (as shown in FIG. 6). Specifically, because of the relative stiffness of support legs 26 (with respect to the walls), the protector will tend to flex along its side and bottom walls in response to the impact. This flexing will effectively disperse the impact energy such that it is not delivered directly to the edge of the article.

As mentioned, if the protector/computer combination is dropped or jarred, the protector is able to effectively dissipate the impact energy imparted thereto. This dissipation is accomplished by both flexing of the protector and absorption of the energy by the protector itself.

In one preferred embodiment, the thickness $w_2$ of the support legs, together with the material durometer, provide relatively stiff support legs (as compared to the walls) that are locally resistant to flexing. Accordingly, the support legs do not collapse under impact. Rather, the impact energy is dispersed throughout the protector, resulting in both flexing of the protector along the side and bottom walls and absorption of the energy by the protector itself. Moreover, the relative stiffness of the support legs provides a stable support base for the computer during use thereof.

Preferably, the protector is fabricated from a polymeric material such as polyurethane, although other resilient materials are also contemplated. The material employed in the protector preferably has a durometer on the order of 80, which provides the protector with a sufficient degree of stiffness to effectively disperse the impact energy.

Figure 7:
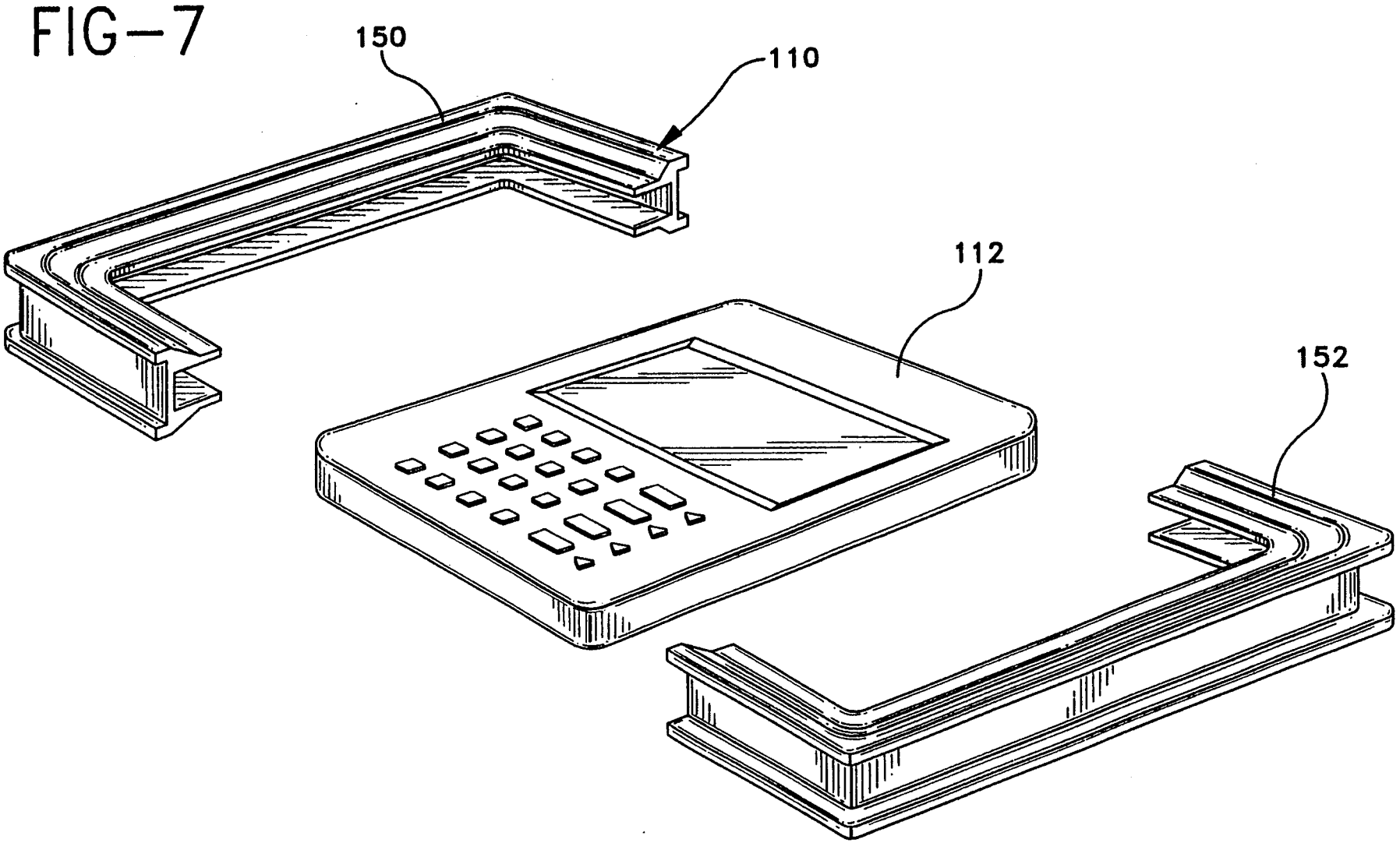
FIG. 7 is a perspective view of an alternative embodiment of the present invention wherein the protector is formed as two symmetrical halves.
Figure 8:
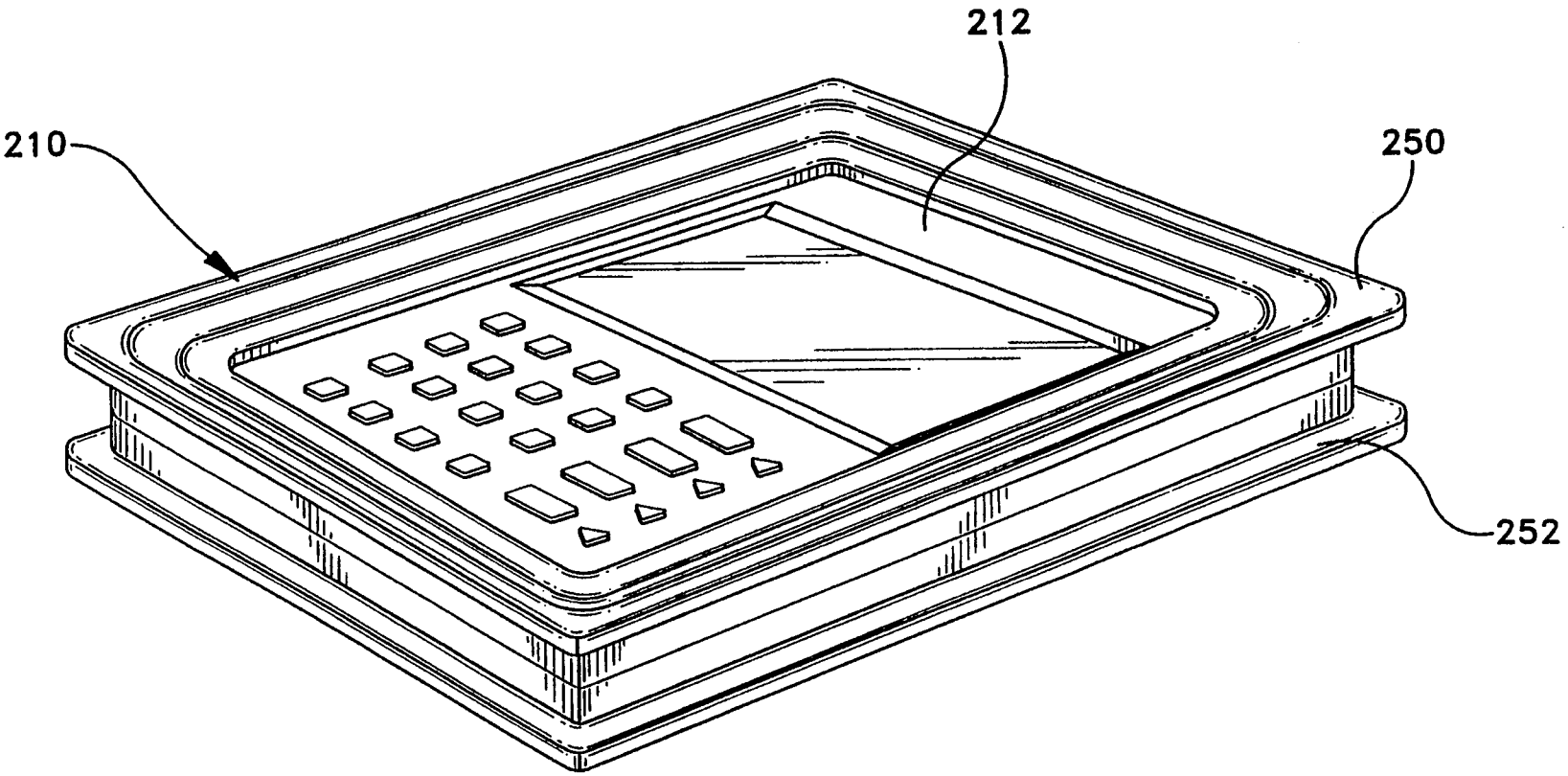
FIG. 8 is a perspective view of an alternative embodiment of the present invention wherein the protector is integrally formed with the casing of the computer.

In one preferred embodiment, as shown in FIG. 7, the protector (i.e., protector 110) is formed as two symmetrical halves 150, 152 which allow such impact protector to be readily installed on and removed from computer 112. In another preferred embodiment, as shown in FIG. 8, the protector (i.e., protector 210 ) is integrally formed with the article itself. For example, the protector may be integrally formed with the casing of computer 212. In such an embodiment, it may be desirable to form the protector as halves 250, 252. In a further preferred embodiment, the protector may be formed as four individual pieces sized for securement to each of the four corners of the article.

Thus, while there have been described what are presently believed to be the preferred embodiments of the invention, those skilled in the art will realize that various changes and modifications may be made to the invention without departing from the spirit of the invention, and is intended to claim all such changes and modifications which fall within the scope of the invention.

What is claimed is:

1. An impact protector for securement to an edge of a fragile article, comprising:

a generally resilient member having a pair of opposing side walls and a bottom wall extending therebetween, said walls defining an article-receiving groove sized to accommodate said edge of said article, said member further including a pair of opposing support legs attached thereto and having support surfaces located thereon which prevent said walls from directly striking a ground plane when said member is dropped thereon.

2. The protector according to claim 1, wherein each of said walls has an inner article-contacting surface and an outer free surface; and wherein each of said inner article-contacting surfaces of said side walls defines a first locating plane having inward and outward sides; and wherein said inner article-containing surface of said bottom wall defines a second locating plane having inward and outward sides.

3. The protector according to claim 2, wherein said support legs are positioned at the intersections of said side and bottom walls, each of said support legs including first and second support surfaces, and wherein said first support surfaces are laterally offset from said outer free surface of said bottom wall and are formed substantially parallel thereto, and wherein said first support surfaces are substantially positioned on said outward sides of said first locating planes.

4. The protector according to claim 2, wherein said support legs are positioned at the intersections of said side and bottom walls, each of said support legs including first and second support surfaces, and wherein said second support surfaces are laterally offset from said outer free surfaces of said side walls and are formed substantially parallel thereto; and wherein said second support surfaces are substantially positioned on said outward side of said second locating plane.

5. The protector according to claim 2, wherein said support legs are positioned at the intersections of said side and bottom walls, each of said support legs including first and second support surfaces, and wherein said first support surfaces are laterally offset from said outer free surface of said bottom wall and are formed substantially parallel thereto, and wherein said second support surfaces are laterally offset from said outer free surfaces of said side walls and are formed substantially parallel thereto.

6. The protector according to claim 5, wherein said walls are sufficiently resilient to allow flexing thereof in response to impact energy imparted on said support surfaces of said legs.

7. The protector according to claim 6, wherein said member is fabricated from a material which facilitates dispersion of impact energy therethrough.

8. The protector according to claim 7, wherein said support legs are relatively stiff in comparison to said walls to facilitate dispersion of impact energy throughout said member.

9. The protector according to claim 5, wherein said side walls are formed substantially perpendicular to said bottom wall, and wherein said first and second support surfaces are formed substantially perpendicular to one another.

10. The protector according to claim 1, wherein said member is fabricated from a polymeric material.

11. The protector according to claim 10, wherein said material comprise polyurethane.

12. The protector according to claim 10, wherein said material has a durometer of 80.

13. The protector according to claim 1, wherein said article-receiving groove releasably engages said edge of said article through a friction fit.

14. The protector according to claim 1, wherein said member is integrally formed with said article during fabrication of said article.

* * * * *